US011299327B2

(12) United States Patent
Simms, II et al.

(10) Patent No.: US 11,299,327 B2
(45) Date of Patent: Apr. 12, 2022

(54) CUP LID WITH ROLL AND SPILL LIMITING RIM

(71) Applicant: Waddington North America, Inc., Chelmsford, MA (US)

(72) Inventors: Russell L. Simms, II, Cleveland, TN (US); Matthew Ravenstein, Amherst, NH (US)

(73) Assignee: Waddington North America, Inc., Chelmsford, MA (US)

( * ) Notice: Subject to any disclaimer, the term of this patent is extended or adjusted under 35 U.S.C. 154(b) by 0 days.

(21) Appl. No.: 16/811,349

(22) Filed: Mar. 6, 2020

(65) Prior Publication Data

US 2020/0283203 A1 Sep. 10, 2020

Related U.S. Application Data

(60) Provisional application No. 62/815,648, filed on Mar. 8, 2019.

(51) Int. Cl.
*B65D 43/02* (2006.01)
*A47G 19/22* (2006.01)

(52) U.S. Cl.
CPC .. *B65D 43/0212* (2013.01); *A47G 2019/2294* (2013.01); *B65D 2543/00046* (2013.01); *B65D 2543/00092* (2013.01); *B65D 2543/00296* (2013.01); *B65D 2543/00537* (2013.01); *B65D 2543/00796* (2013.01)

(58) Field of Classification Search
CPC ..... B65D 43/0212; B65D 2543/00064; B65D 2543/00046; A47G 2019/2294; A47G 19/2272; A47G 19/2266
USPC ..... 220/793
See application file for complete search history.

(56) References Cited

U.S. PATENT DOCUMENTS

| | | | | |
|---|---|---|---|---|
| 5,860,552 | A * | 1/1999 | Culhane | B65D 43/0212 220/212 |
| 6,220,476 | B1 * | 4/2001 | Waller | A47G 19/2272 220/713 |
| D873,136 | S | 1/2020 | Sima et al. | |
| 2004/0245258 | A1 * | 12/2004 | Connors, Jr. | B65D 47/10 220/713 |

* cited by examiner

*Primary Examiner* — Jeffrey R Allen
(74) *Attorney, Agent, or Firm* — Maine Cernota & Rardin

(57) ABSTRACT

A beverage container lid includes a round rim and a flange extending beyond the rim at least proximal to a spout, such that the container, when tipped over with the spout oriented downward, will gravitationally roll until a height of the container's center of mass reaches any of a plurality of local minima. The lid can be configured such that rolling through an angle of no less than 30 degree and/or no more than 90 degrees is required. In some embodiments the flange extends beyond the rim only proximal to the spout, such that the rim contacts an underlying table over a continuous angular range beyond the flange. In other embodiments, the flange extends beyond the rim everywhere, and has a plurality of maximum radii with a plurality of minimum radii interspersed therebetween. In some of these embodiments the flange includes at least one flat, straight line segment.

16 Claims, 9 Drawing Sheets

TOP PERSPECTIVE VIEW

BOTTOM PERSPECTIVE VIEW

3I

TOP VIEW

3I

BOTTOM VIEW

FRONT VIEW

BACK VIEW

LEFT VIEW

RIGHT VIEW

CUP LID WITH ROLL AND SPILL LIMITING RIM

RELATED APPLICATIONS

This application claims the benefit of U.S. Provisional Application No. 62/815,648, filed Mar. 8, 2019, which is herein incorporated by reference in its entirety for all purposes.

FIELD OF THE INVENTION

The invention relates to lids for drink cups, and more specifically to lids that limit spilling of contents from drink cups.

BACKGROUND OF THE INVENTION

Glasses and cups from which beverages are consumed are often taller than they are wide, which leads to the possibility that they can be easily tipped over and spilled. When seated at a table, most adults learn to position their beverage cup or glass well away from the edge of the table and away from areas where they are likely to be inadvertently bumped or tipped, and yet occasional accidents do occur.

For children, spilling of drink cups is even more frequent. Often, beverages are served to young children in cups that are fitted with lids from which a beverage can be consumed through a spout. Such "training" cups are helpful to children who are making the transition from bottles to cups, and also help to minimize spills. Nevertheless, children often place cups near the edges of tables, and are generally less spatially aware than adults, with the result that training cups are frequently knocked over.

Typically, when a child first receives a training cup filled with juice or some other desirable beverage, the child will immediately consume a significant quantity from the cup. However, once the child's initial thirst and/or desire for the beverage is sated, the child may put the partially empty container down on a table or other surface, while he or she proceeds to eat, play, or carry out some other activity. If the cup is then inadvertently tipped over, it may come to rest with the spout near the table or other underlying surface, and the remainder of the beverage may leak out.

One approach that attempts to mitigate this problem is to provide a flange surrounding the rim of the lid such that the radius of the flange is everywhere greater than a radius of the rim, and wherein the radius of the flange varies continuously from a maximum near a drink-through opening of the lid to a minimum opposite to the opening. When the cup is tipped over, this eccentric shape of the flange resting on the underlying surface will cause the cup to be slightly more vertical when the drink opening is closest to the underlying surface, and slightly more horizontal when the drink opening is furthest from the underlying surface. The weight of the beverage inside of the cup therefore causes the cup to roll on the flange such that it comes to rest in the orientation wherein the cup is most nearly horizontal, whereby the center of mass of the beverage is as low as possible, and the drink-through opening is as far as possible above the underlying surface.

While this approach may be desirable when the cup is nearly full and is located well away from the edge of a table, it may serve no purpose when the cup is partially empty unless the cup happens to fall with its spout proximal to the underlying table. And if the cup is located near the edge of a table when it is tipped over, the induced rolling of the cup due to the eccentric lid may cause it to fall off of the table, whereupon the lid is likely to be jarred loose from the cup, such that the entire remaining contents is spilled onto the floor.

What is needed, therefore, is a drink cup lid that will minimize spillage when tipped over, without inducing unnecessary rolling of the cup.

SUMMARY OF THE INVENTION

The present invention is a lid that is compatible for attachment to a substantially round upper lip of a drink cup that also has a substantially round base. The disclosed lid minimizes spillage when the cup and attached lid are tipped over, without inducing unnecessary rolling of the cup across a table or other underlying, horizontal surface. The disclosed lid includes a substantially round rim that firmly engages with the upper lip of the cup. In addition, the lid includes a flange that extends radially outward beyond the rim at least in a region proximal to a drinking spout provided in the lid near the rim, such that a radius of the flange reaches a local maximum directly proximal to the spout.

According to the present invention, when the cup is tipped over, the cup rests upon an edge of its base at its bottom end and, depending on the embodiment and on its rotational orientation, upon either the outer edge of the rim or the flange of the lid at its upper end. Accordingly, an upper perimeter is provided by the lid, either by the flange alone or by the flange in combination with the outer edge of the rim, which makes contact with the table when the cup is tipped over. The flange is configured such that a radius of this upper perimeter takes on local minimum values at a plurality of locations about the lid. In embodiments, the local minima are equally spaced about the lid, and/or equal in size.

Accordingly, upon being tipped over, a cup having the disclosed lid attached thereto will tend to roll, at most, only until a height of its center of mass reaches a local minimum, which will generally correspond with a nearest local minimum of the upper perimeter resting upon or being proximal to the underlying table. In embodiments having two local minima, this will require a rotation of no more than 90 degrees, whereas for embodiments having three local minima a rotation of less than 60 degrees will be required, and so forth.

In one general aspect of the present invention, the flange extends beyond the rim of the lid only in a region proximal to the spout, such that everywhere else the upper perimeter is the rim of the lid, which is substantially constant in radius. The radius of the rim in these embodiments is therefore the minimum radius of the upper perimeter, and since this minimum radius applies to an arced region of the upper perimeter, it represents an infinite number of "minima." In these embodiments, when a cup having the disclosed lid attached thereto is tipped over, the shape of the upper perimeter will not induce the cup to roll unless the cup happens to fall with the spout proximal to the underlying table, such that the flange contacts the table, in which case the cup will tend to roll only far enough to bring the rim of the cup into contact with the table.

In other embodiments the upper perimeter includes a plurality of discrete, spaced apart maxima and minima, and thereby provides a plurality of discrete orientations at which the cup will tend to come to rest when tipped over. In some of these embodiments, the flange extends beyond the rim about its full circumference, such that the upper perimeter of the lid is the perimeter of the flange at all points.

Notably, as a result of having an upper perimeter with a plurality of local radius minima, the disclosed lid will sometimes cause the cup to come to rest in an orientation wherein the spout is not at a maximum distance above the table, thereby providing an opportunity for some contents of the cup to leak out of the spout if the cup was nearly full when it was tipped over. However, as noted above, in many cases, especially for embodiments directed to use by children, the cup will typically not be full when it is tipped over, and will likely be tipped over near the edge of a table. In such cases, little or no beverage will leak from the cup, and the cup will be unlikely to roll off of the table and fall onto the floor due to the limited rolling, if any, that is induced by the shape of the disclosed lid.

It should be noted that, whereas the present invention is sometimes discussed with reference to applications directed to children, the invention is not limited only to such embodiments. Furthermore, it will be noted that the term "table" is used herein broadly to refer to any substantially horizontal surface upon which a cup might rest while having the disclosed lid attached thereto, and upon which it will fall when tipped over. Depending on context, the use of the term "table" as used herein sometimes further implies that the substantially horizontal surface has a terminating edge, such that if the cup after being tipped over rolls beyond the edge it, will gravitationally fall to an underlying "floor."

A first general aspect of the present invention is a lid compatible for attachment to a beverage container so as to form therewith a container assembly, the beverage container having a substantially round container lip and a container wall extending downward therefrom to a substantially round container base. The lid includes a substantially round rim having a substantially uniform radius as measured from a center of the lid, the rim being configured for secure attachment to the container lip, a central lid portion surrounded and bounded by the rim, a spout extending upward from the central lid portion proximal to the rim, the spout being configured for consumption therethrough of a beverage, and a flange extending outward beyond an outer edge of the rim at least in a region of the rim that is proximal to the spout, the flange having a non-uniform radius as measured from the center of the lid. An upper perimeter of the lid is formed by outer edges of the rim and the flange such that when the container assembly is tipped over onto a horizontal surface, the container assembly is supported by a lowest point of the round base and by at least one point on the upper perimeter of the lid. A radius of the upper perimeter of the lid, measured as a function of angular orientation about the center of the lid, includes a plurality of local minimum radii terminating at minimum points and at least a first local maximum radius that passes through the spout and terminates in a first maximum point, such that when the container assembly is tipped over and when the first maximum point momentarily contacts the horizontal surface, the container is gravitationally induced to roll until it assumes an orientation in which a height of its center of gravity is at a local minimum.

In embodiments, the upper perimeter includes at least one segment formed by the outer edge of the rim, said segment being of uniform radius and thereby including an infinite number of contiguous minimum points. In some of these embodiments, the flange extends beyond the rim only in the region proximal to the spout.

In any of the above embodiments, the upper perimeter can be formed entirely by the outer edge of the flange.

In any of the above embodiments, when the first maximum point momentarily contacts the horizontal surface, the container can be required to roll through an angle of no more than 90 degrees so as to reach an orientation in which the height of its center of gravity is at a local minimum.

In any of the above embodiments, when the first maximum point momentarily contacts the horizontal surface, the container can be required to roll through an angle of at least 30 degrees so as to reach an orientation in which the height of its center of gravity is at a local minimum.

In any of the above embodiments, except embodiments where the flange extends beyond the rim only in the region proximal to the spout, the radius of the upper perimeter of the lid, measured as a function of angular orientation about the center of the lid, can include a plurality of local maximum radii.

In any of the above embodiments, the upper perimeter can include at least one segment that is a straight line.

Any of the above embodiments can further include a vent opening provided in the central portion of the lid through which air can enter the container assembly as beverage is consumed therefrom.

A second general aspect of the present invention is a container assembly that includes a beverage container having a substantially round container lip and a container wall extending downward therefrom to a substantially round container base, and a lid compatible for attachment to said beverage container so as to form therewith a container assembly, where the lid includes a substantially round rim having a substantially uniform radius as measured from a center of the lid, the rim being configured for secure attachment to the container lip, a central lid portion surrounded and bounded by the rim, a spout extending upward from the central lid portion proximal to the rim, the spout being configured for consumption therethrough of beverage, and a flange extending outward beyond an outer edge of the rim at least in a region of the rim that is proximal to the spout, the flange having a non-uniform radius as measured from the center of the lid. An upper perimeter of the lid is formed by outer edges of the rim and the flange such that when the container assembly is tipped over onto a horizontal surface, the container assembly is supported by a lowest point of the round base and by at least one point on the upper perimeter of the lid. A radius of the upper perimeter of the lid, measured as a function of angular orientation about the center of the lid, includes a plurality of local minimum radii terminating at minimum points and at least a first local maximum radius that passes through the spout and terminates in a first maximum point, such that when the container assembly is tipped over and when the first maximum point momentarily contacts the horizontal surface, the container is gravitationally induced to roll until it assumes an orientation in which a height of its center of gravity is at a local minimum.

In embodiments, the upper perimeter includes at least one segment formed by the outer edge of the rim, said segment being of uniform radius and thereby including an infinite number of contiguous minimum points. In some of these embodiments, the flange extends beyond the rim only in the region proximal to the spout.

In any of the above embodiments, the upper perimeter can be formed entirely by the outer edge of the flange.

In any of the above embodiments, when the first maximum point momentarily contacts the horizontal surface, the container can be required to roll through an angle of no more than 90 degrees so as to reach an orientation in which the height of its center of gravity is at a local minimum.

In any of the above embodiments, when the first maximum point momentarily contacts the horizontal surface, the container can be required to roll through an angle of at least 30 degrees so as to reach an orientation in which the height of its center of gravity is at a local minimum.

In any of the above embodiments, except for embodiments wherein the flange extends beyond the rim only in the region proximal to the spout, the radius of the upper perimeter of the lid, measured as a function of angular orientation about the center of the lid, can includes a plurality of local maximum radii.

In any of the above embodiments, the upper perimeter can include at least one segment that is a straight line.

And any of the above embodiments can further include a vent opening provided in the central portion of the lid through which air can enter the container assembly as beverage is consumed therefrom.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
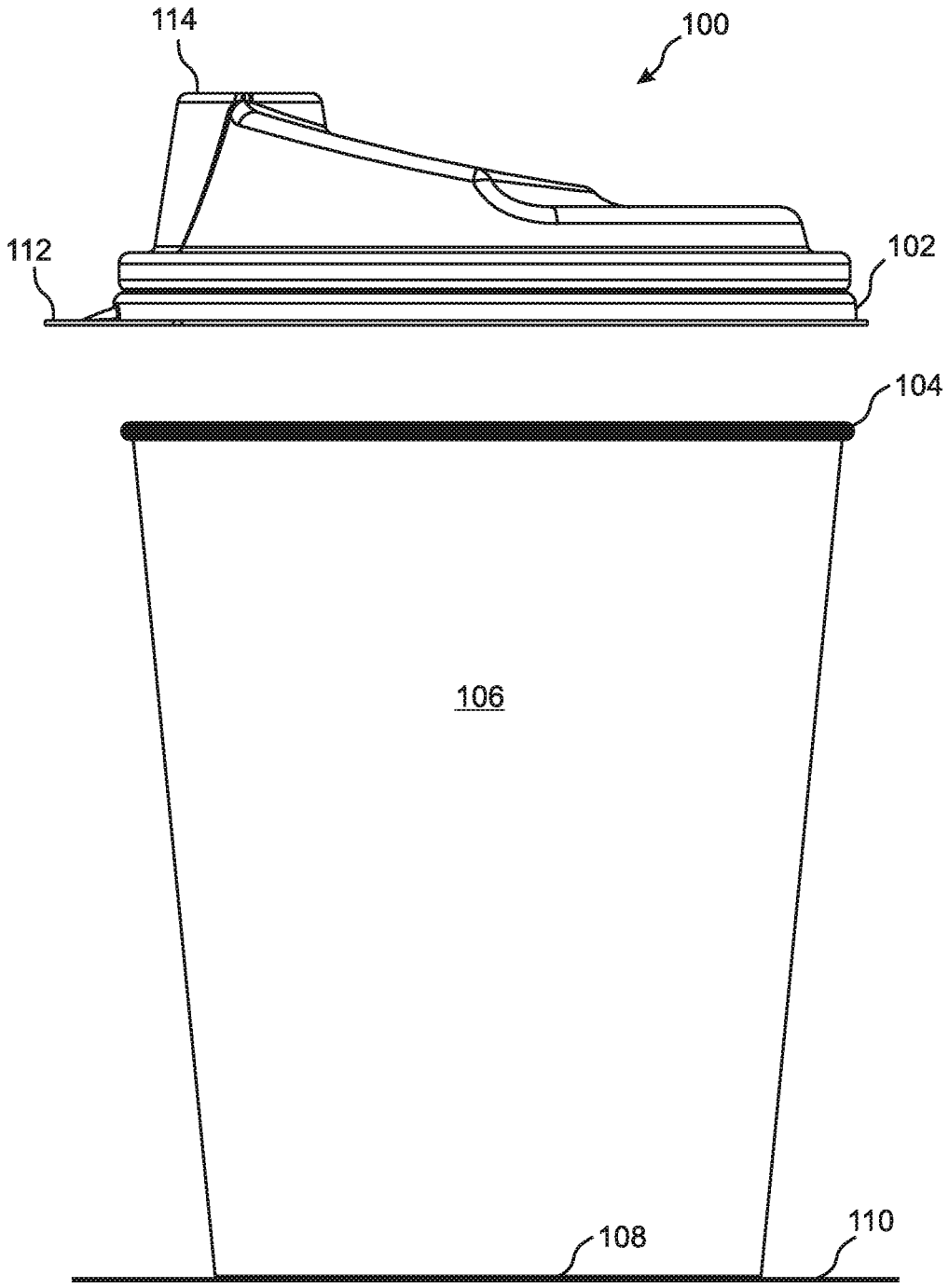
FIG. 1A is side view of a lid, drawn to scale, positioned above an underlying beverage container according to an embodiment of the present invention.

With reference to FIG. 1, the present invention is a lid 100 that includes a substantially round rim 102 that is compatible for attachment to a substantially round upper lip 104 of a drink cup 106 that also has a substantially round base 108. The disclosed lid 100 minimizes spillage when the cup 106 and attached lid 100 are tipped over, without inducing unnecessary rolling of the cup 106 across a table 110 or other underlying, horizontal surface. In FIG. 1, the lid 100 is shown detached and positioned above the cup 106. When the lid 100 is pressed onto the cup 106, the rim 102 of the lid 100 firmly engages with the upper lip 104 of the cup 106 and will not fall off when the cup 106 is tipped over onto the table 110.

Figure 1B:
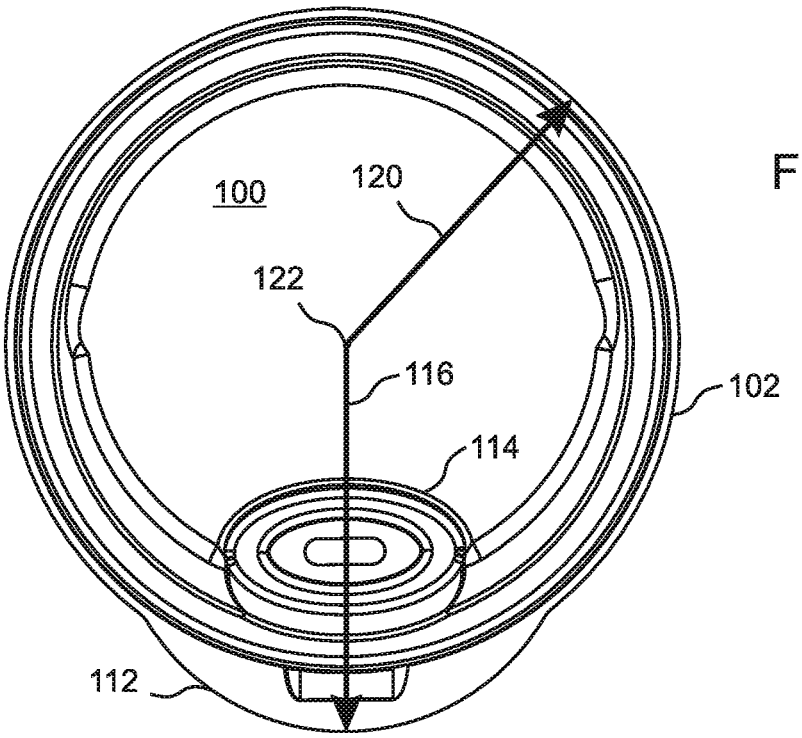
FIG. 1B is a top view drawn to scale of the lid of FIG. 1A.

With reference also to FIG. 1B, in addition to the rim 102, or as an extension of the rim 102 (as shown in FIG. 1B), the lid 100 includes a flange 112 that extends radially outward beyond the rim 102 at least in a region proximal to a drinking spout 114 provided in the lid near the rim 102, such that a radius 116 of the flange 112 reaches a local maximum directly proximal to the spout 114.

Figure 1C:
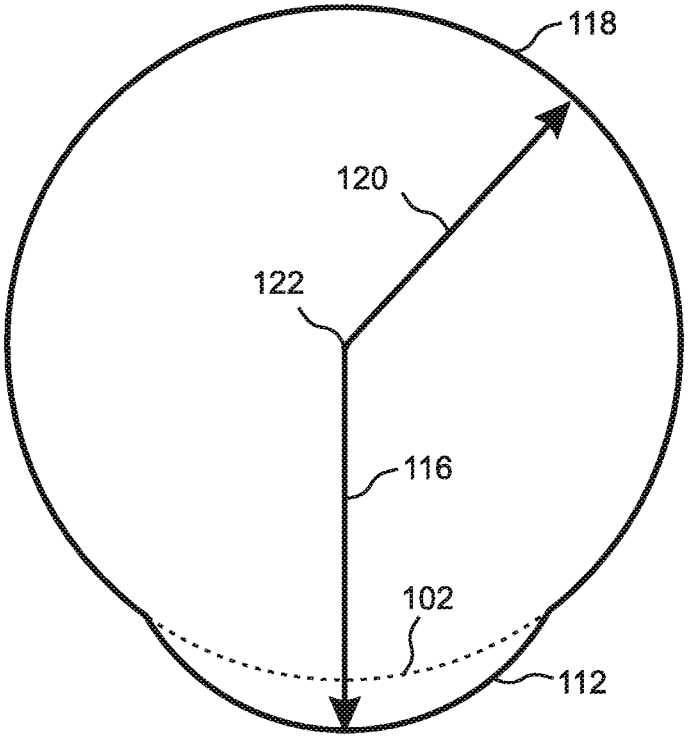
FIG. 1C is a top view drawn to scale of the upper perimeter of the lid of FIG. 1B.
Figure 2A:
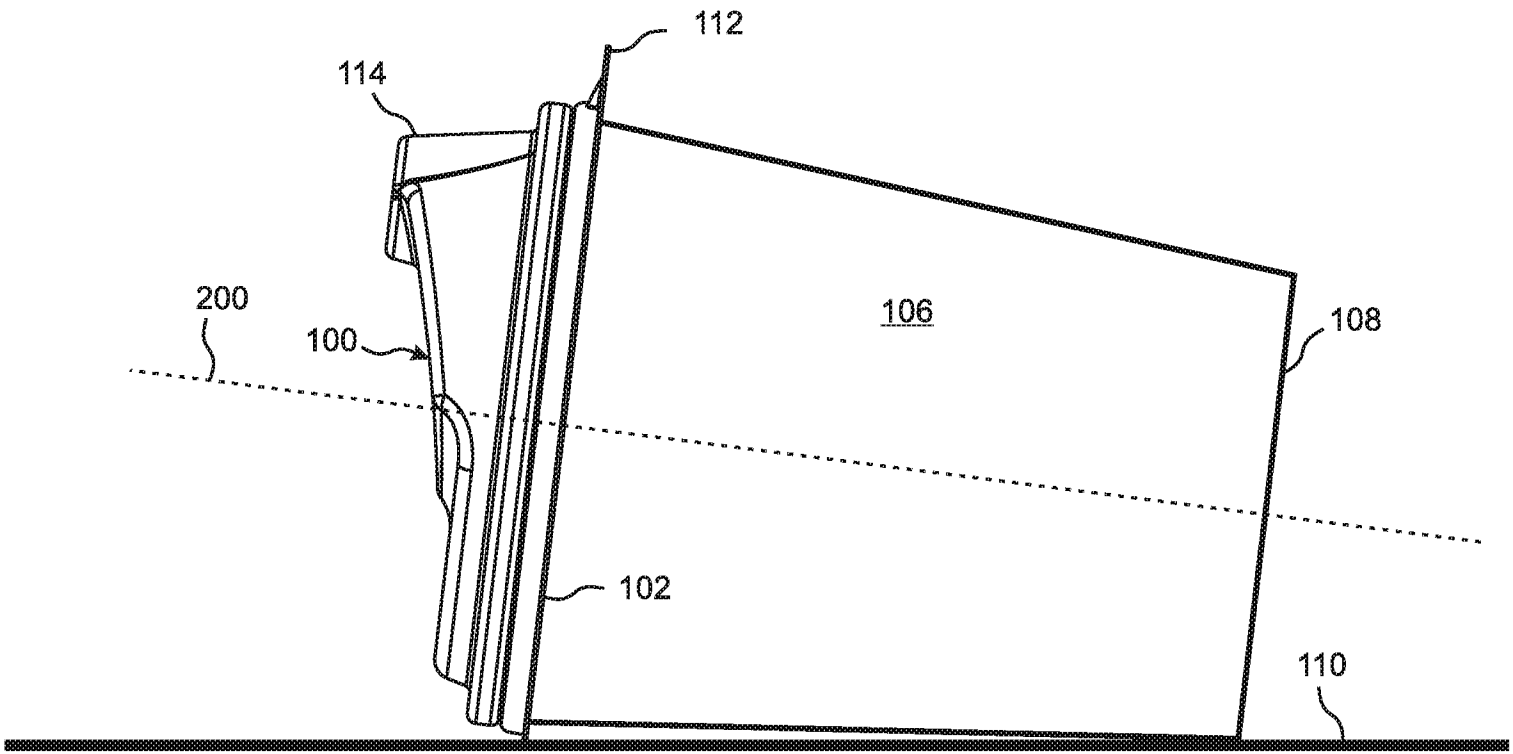
FIG. 2A is a side view of the assembled lid, drawn to scale, and container of FIG. 1A shown tipped over onto a table with the spout of the lid oriented upward.
Figure 2B:
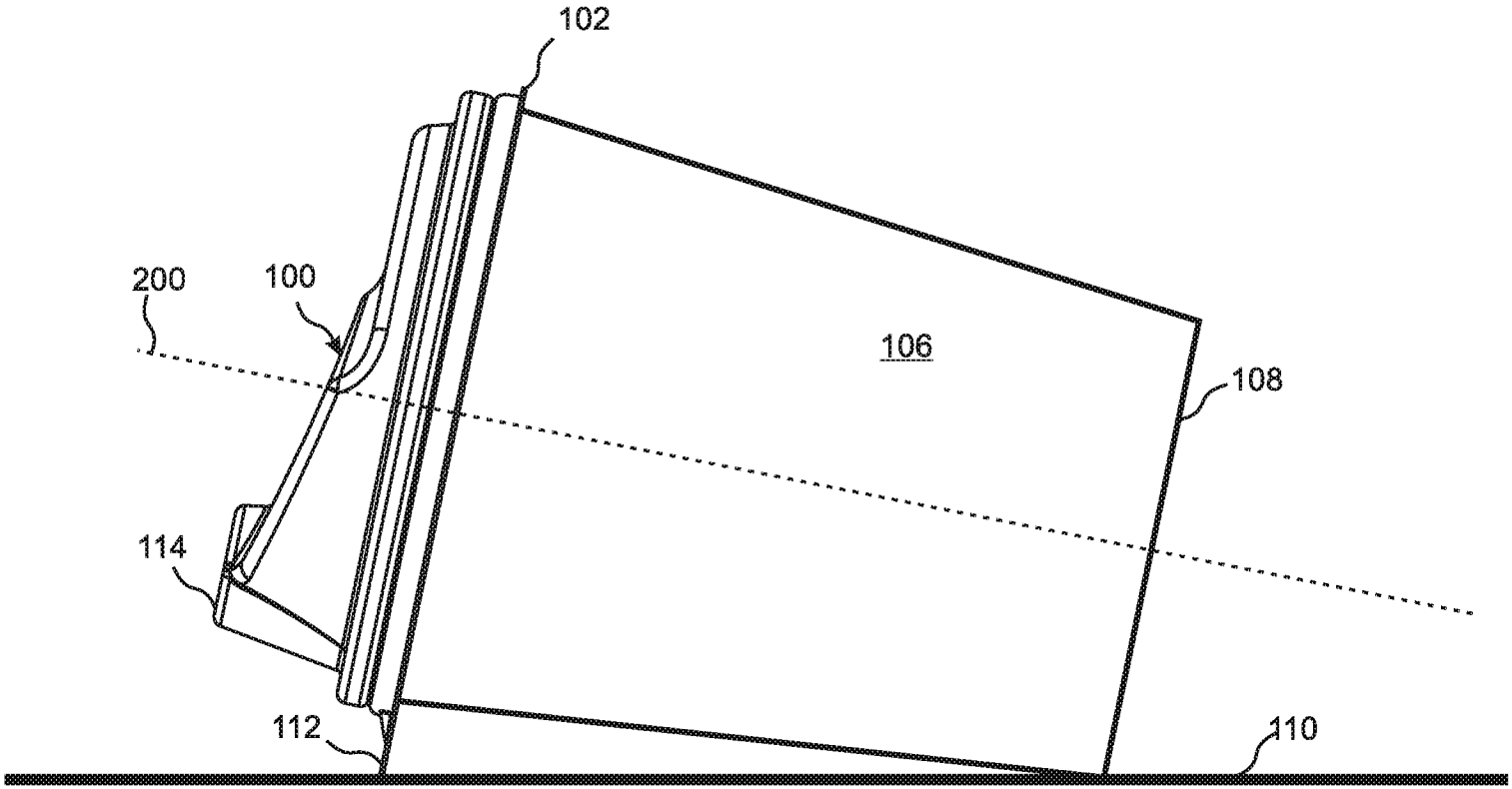
FIG. 2B is a side view of the assembled lid, drawn to scale, and container of FIG. 1A shown tipped over onto a table with the spout of the lid oriented downward.

With reference to FIGS. 2A and 2B, according to the present invention, when the cup 106 is tipped over, at its bottom end the cup 106 rests upon an edge of its base 108 and at its upper end, depending on the embodiment and on its rotational orientation, upon either the outer edge of the rim 102, as shown in FIG. 2A, or the edge of the flange 112 as shown in FIG. 2B. Accordingly, as shown in FIG. 1C, an upper perimeter 118 is provided which makes contact with the table 110 when the cup 106 is tipped over. Depending on the embodiment, the upper perimeter 118 is provided either by the flange alone 112 or, as shown in FIG. 1C, by the flange 112 in combination with the rim 102. The flange 112 is configured such that a radius 120 of this upper perimeter 118 takes on local minimum values at a plurality of locations about the lid. In embodiments, the local minima are equally spaced about the lid, and/or equal in size.

In one general aspect of the present invention, as illustrated in FIGS. 1A through 3J, the flange 112 extends beyond the rim 102 of the lid 100 only in a region proximal to the spout 114, such that everywhere else the upper perimeter 118 is the outer edge of the rim 102 of the lid 100, which is substantially constant in radius 120 and represents the minimum radius 120 of the upper perimeter 118. Therefore, rather than a finite number of discrete, separated minima, the radius 120 of the upper perimeter takes on its minimum value over this entire portion, thereby providing an infinite number of contiguous points along this continuous section of the upper perimeter 118, all of which are "minima."

Accordingly, with reference again to FIG. 2A, if the cup 106 is tipped over such that the rim 102 of the lid 100 makes contact with the table 110, then the center line 200 of the cup 106 will be as horizontal as it can be, the height of the center of mass of the cup 106 will be at a minimum, and the lid 100 will not induce the cup 106 to roll. On the other hand, with reference to FIG. 2B, if the cup 106 is tipped over such that the flange 112 of the lid 100 makes contact with the table 110, then the shape of the flange 112 will cause the cup 106 to roll to one side or the other, but only until the rim 102 comes into contact with the table 110. Typically, the cup 106 will rest in an orientation wherein both the flange 112 and the rim 102 are touching the table 110, as shown in FIG. 2C.

Figure 2C:
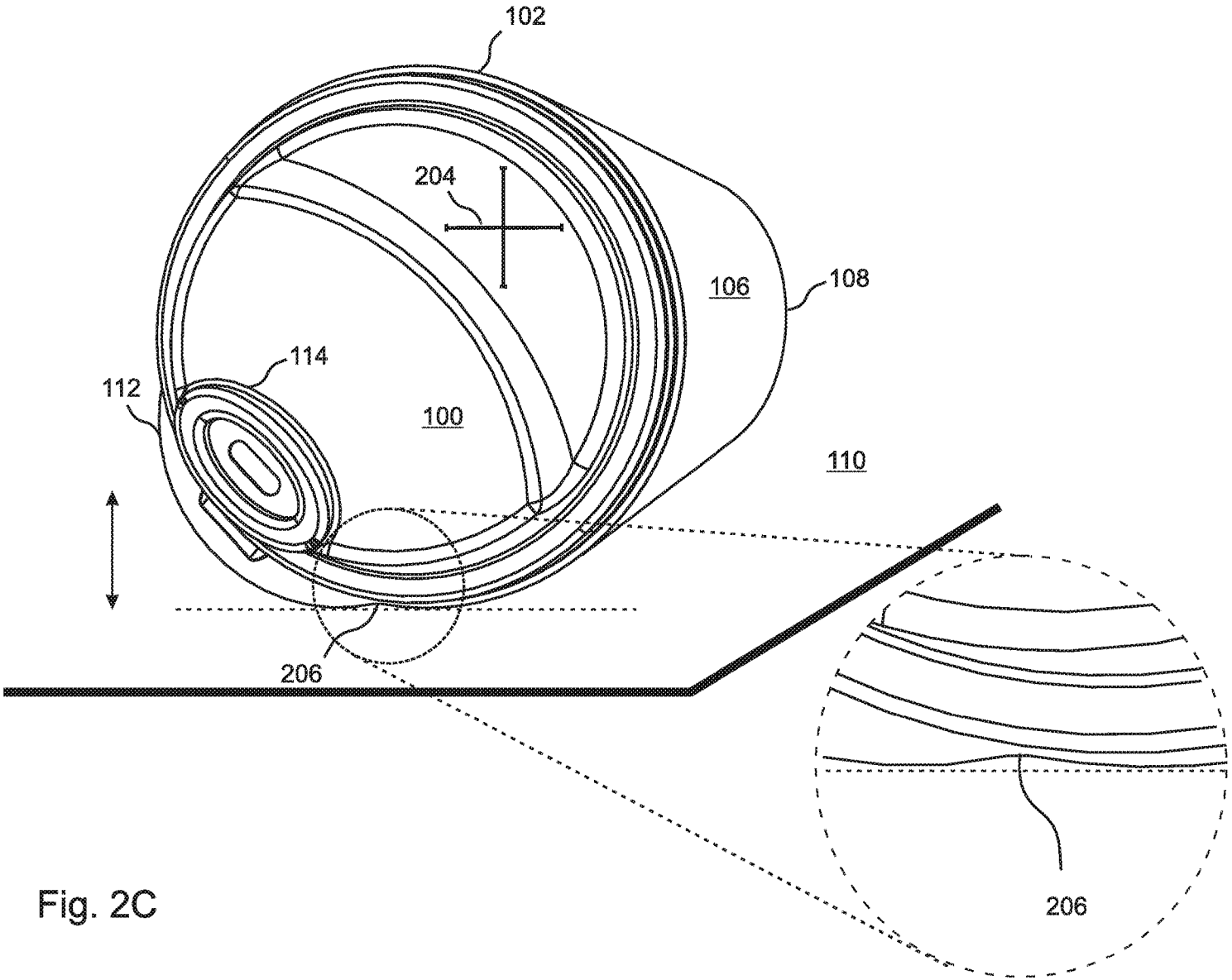
FIG. 2C is a perspective side view of the assembly of FIG. 2B, wherein the lid is drawn to scale, shown after having rolled to an orientation in which the height above the table of the center of mass of the container assembly has reached a minimum.

As can be seen in the inset provided in FIG. 2C, the cup 106 will come to rest in an orientation wherein a height of its center of mass reaches a local minimum. This will generally correspond with a nearest local minimum 206 of the upper perimeter 118 being proximal to the underlying table 110, but may not imply that the local minimum 206 of the upper perimeter 118 actually makes contact with the table 110. As can be seen more clearly in FIGS. 1B and 1C, the flange 112 extends beyond the outer edge of the rim 102 only within an angular range of about 80 degrees as measured about the center 122 of the lid 100, thereby requiring the cup 106, in the worst case, to roll through an angle of no more than 40 degrees before its center of mass reaches its minimum height above the table 110. In various embodiments, the maximum roll angle can be as little as 30 degrees. In embodiments, the maximum roll angle does not exceed 90 degrees.

Note that the lid in FIG. 2C further includes a pair of slots 204 that can be penetrated by a straw. Similar embodiments include one or more vent holes and/or other venting provisions, either in the location indicated in the figure or in one or more other locations of the lid 100.

Figure 3A:
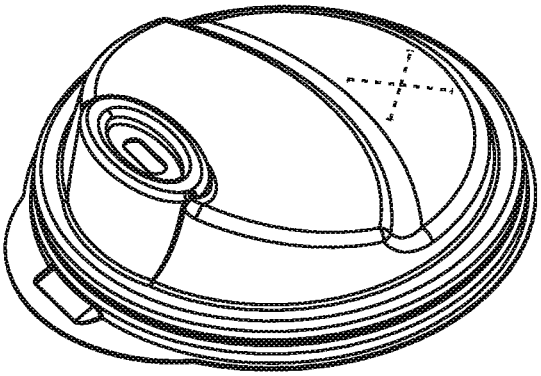
FIG. 3A is a perspective top view drawn to scale of the lid of FIG. 2C.
Figure 3B:
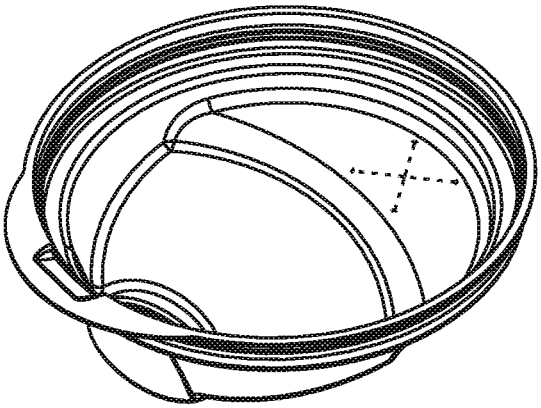
FIG. 3B is a perspective bottom view drawn to scale of the lid of FIG. 2C.
Figure 3C:
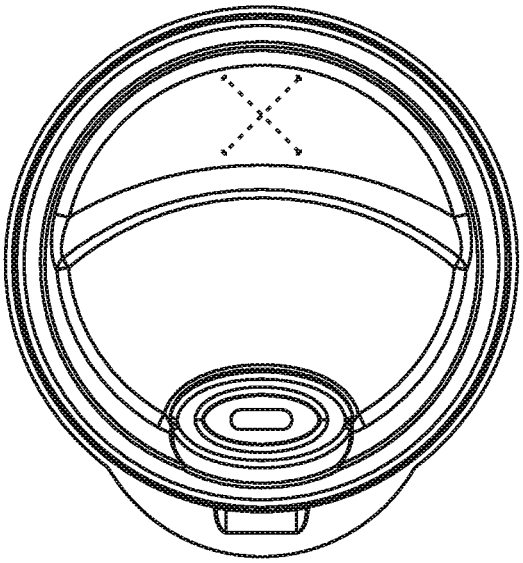
FIG. 3C is a top view drawn to scale of the lid of FIGS. 3A and 3B.
Figure 3D:
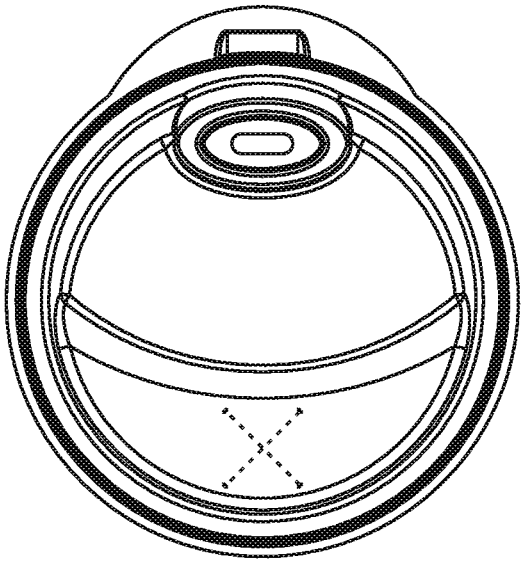
FIG. 3D is a bottom view drawn to scale of the lid of FIGS. 3A and 3B.
Figure 3E:
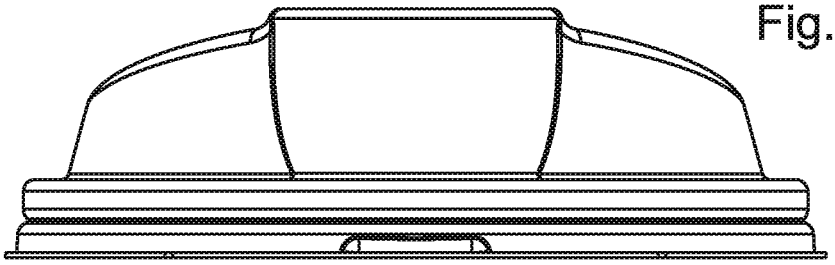
FIG. 3E is a front view drawn to scale of the lid of FIGS. 3A and 3B.
Figure 3F:
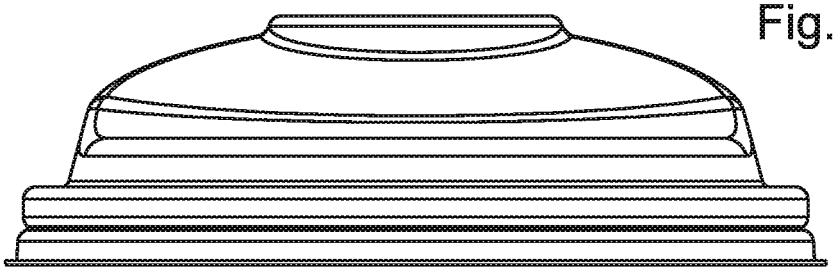
FIG. 3F is a back view drawn to scale of the lid of FIGS. 3A and 3B.
Figure 3G:
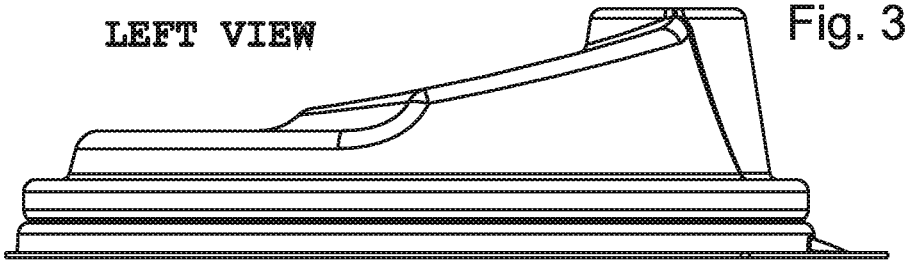
FIG. 3G is a left side view drawn to scale of the lid of FIGS. 3A and 3B.
Figure 3H:
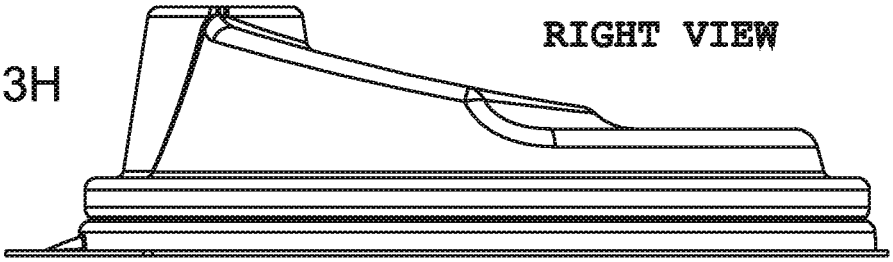
FIG. 3H is a right side view drawn to scale of the lid of FIGS. 3A and 3B.
Figure 3I:
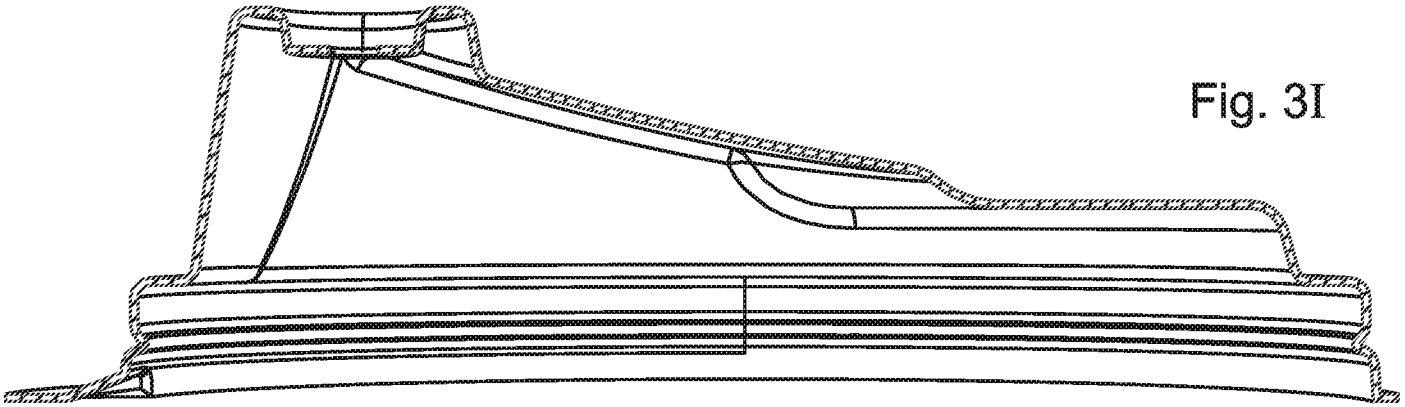
FIG. 3I is a sectional side view drawn to scale of the lid of FIG. 3H.
Figure 3J:
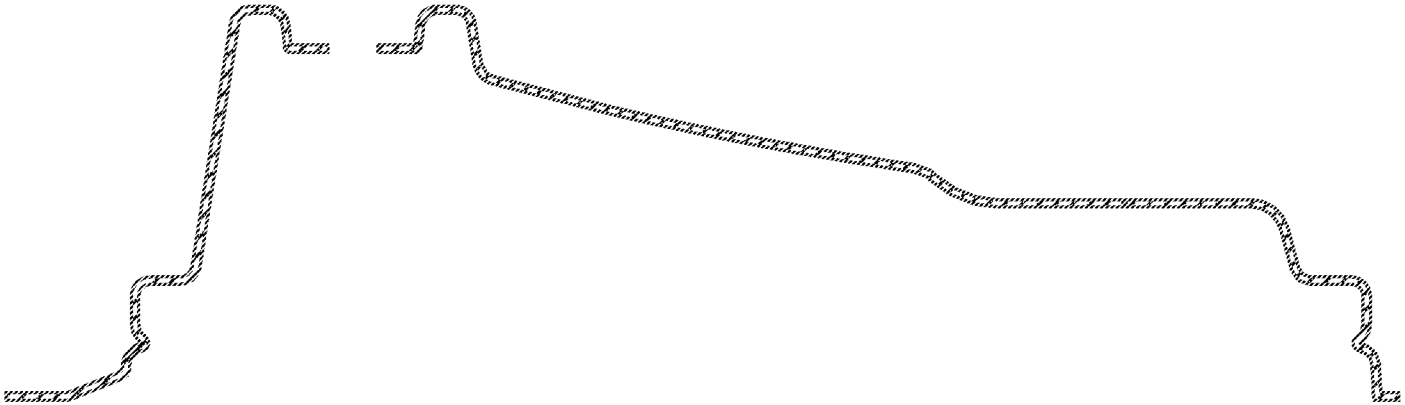
FIG. 3J is a cross-sectional side view drawn to scale of the lid of FIG. 3H.
Figure 4:
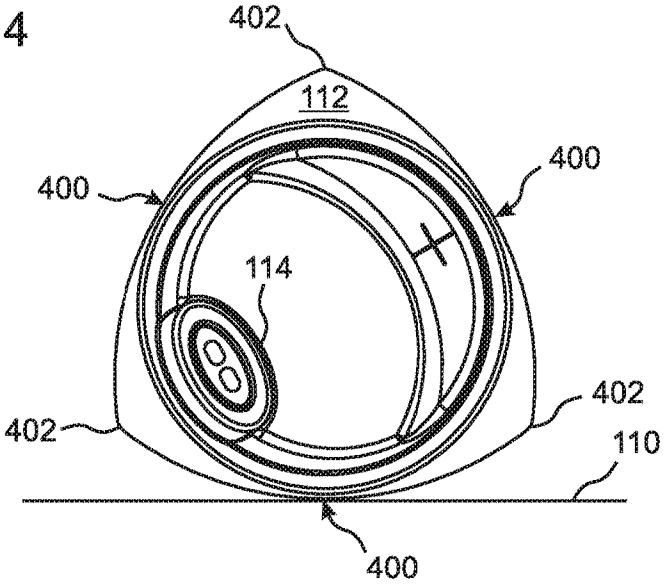
FIG. 4 is a top view of a lid drawn to scale in an embodiment where the radius of the flange includes three maxima interspersed with three minima.
Figure 5A:
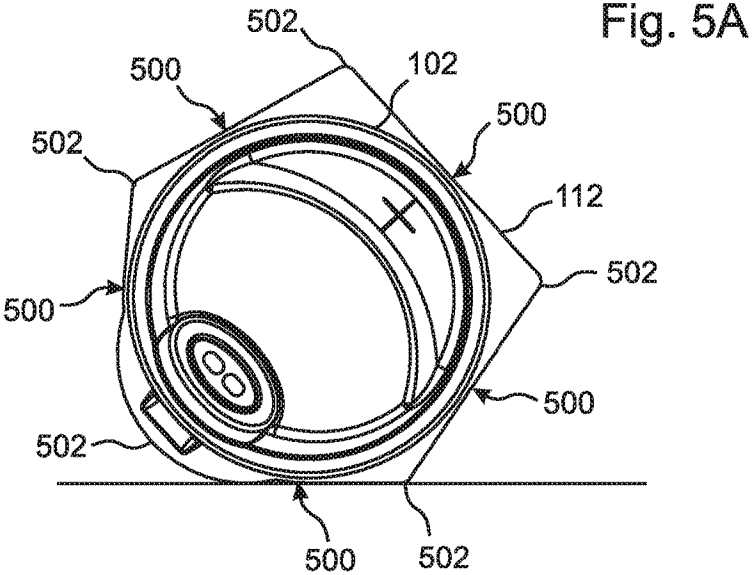
FIG. 5A is a top view shown at a first orientation of a lid drawn to scale in an embodiment where the edge of the flange includes five straight segments.
Figure 5B:
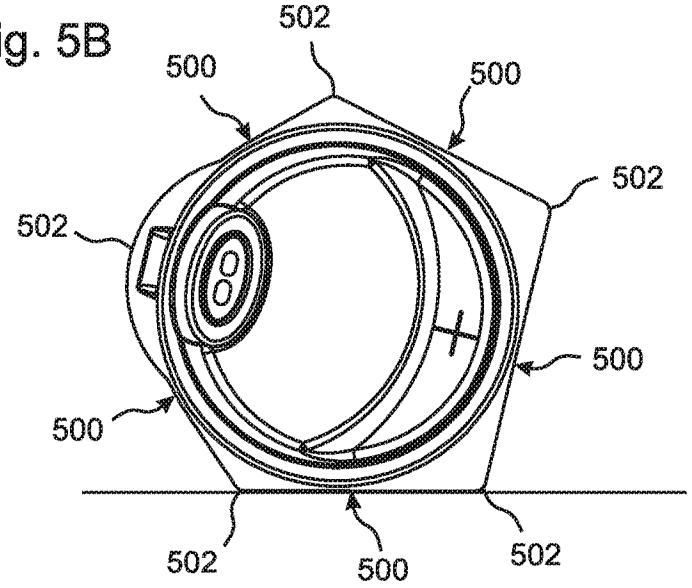
FIG. 5B is a top view shown at a second orientation of a lid drawn to scale in an embodiment where the edge of the flange includes five straight segments.
Figure 5C:
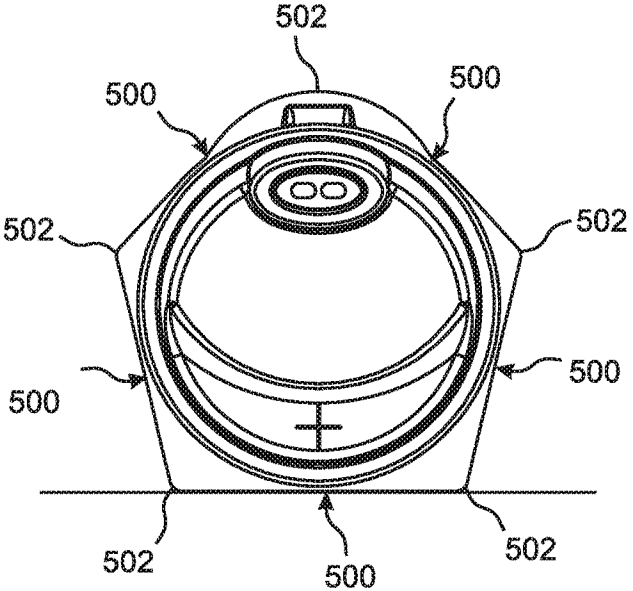
FIG. 5C is a top view shown at a third orientation of a lid drawn to scale in an embodiment where the edge of the flange includes five straight segments.

FIGS. 3A and 3B are perspective top and bottom views, respectively, of the lid of FIG. 2C, while FIGS. 3C and 3D are top and bottom views, respectively, of the same lid. FIGS. 3E, 3F, 3G, and 3H are respectively front, back, left, and right views of the lid of FIG. 2C, while FIGS. 3I and 3J are sectional and cross-sectional views of the same lid, taken along the cut plane indicated in FIG. 3C.

Accordingly, upon being tipped over, a cup 106 having the disclosed lid 100 attached thereto will tend to roll, at most, only until the height of its center of mass reaches a nearest local minimum, which will generally correspond with a local minimum 206 of the upper perimeter 118 resting on or being proximal to the underlying table 110.

While the embodiment of FIGS. 1A through 3J provide a continuous region of minimum upper perimeter radius, with reference to FIGS. 4 and 5A-5C, in other embodiments the radius 120 of the upper perimeter 118 includes a finite number of maximum and minima. For example, in embodiments having two local minima a rotation of no more than 90 degrees is required to reach a minimum in the height of the center of mass, whereas for embodiments such as the one illustrated in FIG. 4 that have three local minima 400 and three corresponding local maxima 402 a rotation of less than 60 degrees will be required, for embodiments such as the one illustrated in FIGS. 5A through 5C having four local minima 500 and four local maxima 502 less than 40 degrees will be required, and so forth. In some of these embodiments, as is illustrated in FIGS. 4 and 5A-5C, the flange 112 extends beyond the rim 102 about the full circumference of the rim 102, such that the upper perimeter 118 of the lid is the perimeter of the flange 112.

Notably, as a result of having an upper perimeter with a plurality of local radius minima, the disclosed lid will sometimes cause the cup to come to rest in an orientation wherein the spout 114 is not at a maximum distance above the table 110, thereby providing an opportunity for some contents of the cup 106 to leak out of the spout 114 if the cup 1106 was nearly full when it was tipped over. However, as noted above, in many cases, especially for embodiments directed to use by children, the cup 106 will not be full when it is tipped over, and will likely be tipped over near the edge of a table 110. In such cases, little or no beverage will leak from the cup 106, and the cup 106 will be unlikely to roll off of the table 110 and fall onto the floor due to the limited rolling, if any, that is induced by the shape of the disclosed lid 100.

It should be noted that, whereas the present invention is sometimes discussed with reference to applications directed to children, the invention is not limited only to such embodiments. Furthermore, it will be noted that the term "table" is used herein broadly to refer to any substantially horizontal surface upon which a cup might rest while having the disclosed lid attached thereto, and upon which it will fall when tipped over. Depending on context, the use of the term "table" as used herein sometimes further implies that the substantially horizontal surface has a terminating edge, such that if the cup after being tipped over rolls beyond the edge it, will gravitationally fall to an underlying "floor."

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. A lid compatible for attachment to a beverage container so as to form therewith a container assembly, the beverage container having a substantially round container lip and a container wall extending downward therefrom to a substantially round container base, the lid comprising:

a substantially round rim having a substantially uniform radius as measured from a center of the lid, the rim being configured for secure attachment to the container lip;

a central lid portion surrounded and bounded by the rim;

a spout extending upward from the central lid portion proximal to the rim, the spout being configured for consumption therethrough of a beverage; and a flange extending outward beyond an outer edge of the rim at least in a region of the rim that is proximal to the spout, the flange having a non-uniform radius as measured from the center of the lid, the flange extending circumferentially beyond the spout on both sides thereof;

an upper perimeter of the lid being formed by outer edges of the rim and the flange such that when the container assembly is tipped over onto a horizontal surface, the container assembly is supported by a lowest point of the round base and by at least one point on the upper perimeter of the lid;

wherein a radius of the upper perimeter of the lid, measured as a function of angular orientation about the center of the lid, includes a plurality of local minimum radii terminating at minimum points and at least a first local maximum radius that passes through the spout and terminates in a first maximum point, such that when the container assembly is tipped over and when the first maximum point momentarily contacts the horizontal surface, the container is gravitationally induced to roll until it assumes an orientation in which a height of its center of gravity is at a local minimum, wherein the container is required to roll through an angle of no more than 90 degrees so as to reach the orientation at which the height of its center of gravity is at a local minimum.

2. The lid of claim 1, wherein said upper perimeter includes at least one segment formed by the outer edge of the rim, said segment being of uniform radius and thereby including an infinite number of contiguous minimum points.

3. The lid of claim 2, wherein the flange extends beyond the rim only in the region proximal to the spout.

4. The lid of claim 1, wherein the upper perimeter is formed entirely by the outer edge of the flange.

5. The lid of claim 1, wherein when the first maximum point momentarily contacts the horizontal surface, the container is required to roll through an angle of at least 30 degrees so as to reach an orientation in which the height of its center of gravity is at a local minimum.

6. The lid of claim 1, wherein the radius of the upper perimeter of the lid, measured as a function of angular orientation about the center of the lid, includes a plurality of local maximum radii.

7. The lid of claim 1, wherein the upper perimeter includes at least one segment that is a straight line.

8. The lid of claim 1, further comprising a vent opening provided in the central portion of the lid through which air can enter the container assembly as beverage is consumed therefrom.

9. A container assembly comprising:

a beverage container having a substantially round container lip and a container wall extending downward therefrom to a substantially round container base; and a lid compatible for attachment to said beverage container so as to form therewith a container assembly, the lid comprising:

a substantially round rim having a substantially uniform radius as measured from a center of the lid, the rim being configured for secure attachment to the container lip;

a central lid portion surrounded and bounded by the rim;

a spout extending upward from the central lid portion proximal to the rim, the spout being configured for consumption therethrough of beverage; and a flange extending outward beyond an outer edge of the rim at least in a region of the rim that is proximal to the spout, the flange having a non-uniform radius as measured from the center of the lid;

an upper perimeter of the lid being formed by outer edges of the rim and the flange such that when the container assembly is tipped over onto a horizontal surface, the container assembly is supported by a lowest point of the round base and by at least one point on the upper perimeter of the lid;

wherein a radius of the upper perimeter of the lid, measured as a function of angular orientation about the center of the lid, includes a plurality of local minimum radii terminating at minimum points and a plurality of local maximum radii terminating at minimum points, said local maximum radii including a first local maximum radius that passes through the spout and terminates in a first maximum point, such that when the container assembly is tipped over and when the first maximum point momentarily contacts the horizontal surface, the container is gravitationally induced to roll until it assumes an orientation in which a height of its center of gravity is at a local minimum wherein the container is required to roll through an angle of no more than 90 degrees so as to reach the orientation at which the height of its center of gravity is at a local minimum.

10. The container assembly of claim 9, wherein said upper perimeter includes at least one segment formed by the outer edge of the rim, said segment being of uniform radius and thereby including an infinite number of contiguous minimum points.

11. The container assembly of claim 10, wherein the flange extends beyond the rim only in the region proximal to the spout.

12. The container assembly of claim 9, wherein the upper perimeter is formed entirely by the outer edge of the flange.

13. The container assembly of claim 9, wherein when the first maximum point momentarily contacts the horizontal surface, the container is required to roll through an angle of at least 30 degrees so as to reach an orientation in which the height of its center of gravity is at a local minimum.

14. The container assembly of claim 9, wherein the radius of the upper perimeter of the lid, measured as a function of angular orientation about the center of the lid, includes a plurality of local maximum radii.

15. The container assembly of claim 9, wherein the upper perimeter includes at least one segment that is a straight line.

16. The container assembly of claim 9, further comprising a vent opening provided in the central portion of the lid through which air can enter the container assembly as beverage is consumed therefrom.

* * * * *